United States Patent [19]

Jarochowski

[11] Patent Number: 5,025,428

[45] Date of Patent: Jun. 18, 1991

[54] ELECTROMAGNETIC ESCAPEMENT FOR MECHANICALLY DRIVEN WATCH OR CLOCK

[76] Inventor: Wit Jarochowski, 14603 S. Xenophon Ave., Glenpool, Okla. 74033

[21] Appl. No.: 628,102

[22] Filed: Dec. 17, 1990

[51] Int. Cl.[5] ..... G04B 15/00; G04F 1/00

[52] U.S. Cl. ..... 368/126; 368/160

[58] Field of Search ..... 368/124–126, 368/155, 157, 184, 203, 206–208

[56] References Cited

U.S. PATENT DOCUMENTS

| | | | |
|---|---|---|---|
| 2,750,552 | 6/1956 | Ryan | 368/184 |
| 3,518,464 | 6/1970 | Kawakami et al. | 310/22 |
| 3,660,737 | 5/1972 | Sakai et al. | 318/138 |
| 3,892,066 | 7/1975 | Watkins | 368/124 |
| 4,007,582 | 2/1977 | Dugan et al. | 58/23 |
| 4,162,417 | 7/1979 | Grudzinski | 310/21 |

*Primary Examiner*—Vit W. Miska
*Attorney, Agent, or Firm*—Head & Johnson

[57] ABSTRACT

A mechanically driven clock, watch, or other timing device having a mechanical energy generator supplying a driving force. A rotatable rotor engages with a driving force resulting in rotational force in a radial direction on the rotor. A magnetically permeable stator surrounds the rotor. The rotor has a permanent magnet supplying an attractive force on the stator at least as strong as the rotational force in order to retain or lock the rotor in position. A magnet field is electromagnetically induced in the stator to provide a rotational force in the rotor in the direction of the mechanical generator driving force sufficient to overcome the permanent magnetic force and allow the rotor to rotate, whereby rotation of the rotor will be regulated.

4 Claims, 2 Drawing Sheets

*Fig. 2*

ELECTROMAGNETIC ESCAPEMENT FOR MECHANICALLY DRIVEN WATCH OR CLOCK

BACKGROUND OF THE INVENTION

1. Field of the Invention

The present invention relates to an escapement, control or governing mechanism for clocks, watches or other timing devices having mechanical drive mechanisms.

2. Prior Art

Various types of escapement mechanisms are known to control the speed of a clock, watch or other timing device. The escapement mechanism constrains, governs and controls the power mechanism to move at a constant rate. Without an escapement mechanism in a mainspring clock, for instance, the timekeeping device will often run fast initially and then slow.

An escapement mechanism engages with the power or drive mechanism of the time keeping device. It is, however, separate and distinct from the power mechanism. Although it does not drive the time keeping device, it controls the speed of release, and hence the time.

There are various forms of known escapement mechanisms for mechanically driven timekeeping devices. One type of escapement mechanism is governed by a pendulum. These include anchor or recoil and dead beat types. Alternately, a balance wheel, balance spring and pallet fork may be utilized.

Quartz crystal resonators and other electronic devices form another group of timekeeping devices. These, however, have no escapement mechanism at all and have no application to the present invention.

Applicant has conducted a patentability search and is aware of the following U.S. patents.

| U.S. Pat. No. | INVENTOR |
|---|---|
| 3,518,464 | Kawakami et al. |
| 3,660,737 | Sakai et al. |
| 4,007,582 | Dugan et al. |
| 4,162,417 | Grudzinski |

Grudzinski (U.S. Pat. No. 4,162,417) discloses an electromagnetic drive motor wherein an electrical charge of short duration distorts a spring which, in turn, drives a tooth wheel.

Dugan et al. (U.S. Pat. No. 4,007,582) discloses an electrodynamic drive mechanism which is connected with an additional circuit consisting of a quartz crystal generator and pulse forming circuit.

Accordingly, it is a principal object and purpose of the present invention to provide an escapement mechanism for a mechanical clock, watch, or other timing device which utilizes an electromagnetic charge in combination with a step motor to provide a durable and accurate escape mechanism.

SUMMARY OF THE INVENTION

The present electromagnetic escapement is directed to mechanically driven watches, clocks, and other timekeeping devices having a mechanical energy generator. The mechanical energy generator may consist of a mainspring, self winding mechanism, or driving weight suspended from a chain.

The mechanical energy generator is drivingly connected to an energy transmission system which includes a gear train. The last gear of the gear train is drivingly engaged with a cylindrical rotor which is allowed to rotate about a shaft. Accordingly, the drive force of the energy generator is translated to rotational force on the rotor. The rotor is surrounded by a stator constructed of a magnetically permeable substance. The rotor itself includes a permanent magnet which supplies an attractive force on the stator. The attractive force of the permanent magnet is at least as strong as the rotational force supplied by the mechanical energy generator so that the rotor is retained or locked in place.

A magnetic field is periodically induced electromagnetically in the stator. The magnetic field polarizes the stator, providing a rotational force on the rotor in the same direction as the driving force of the mechanical energy generator. The induced magnetic field rotational force, along with the mechanical generator driving force, is sufficient to overcome the permanent magnetic force between the rotor and stator and, thereby, allow the rotor to rotate.

DETAILED DESCRIPTION OF THE PREFERRED EMBODIMENTS

Figures 1, 2:
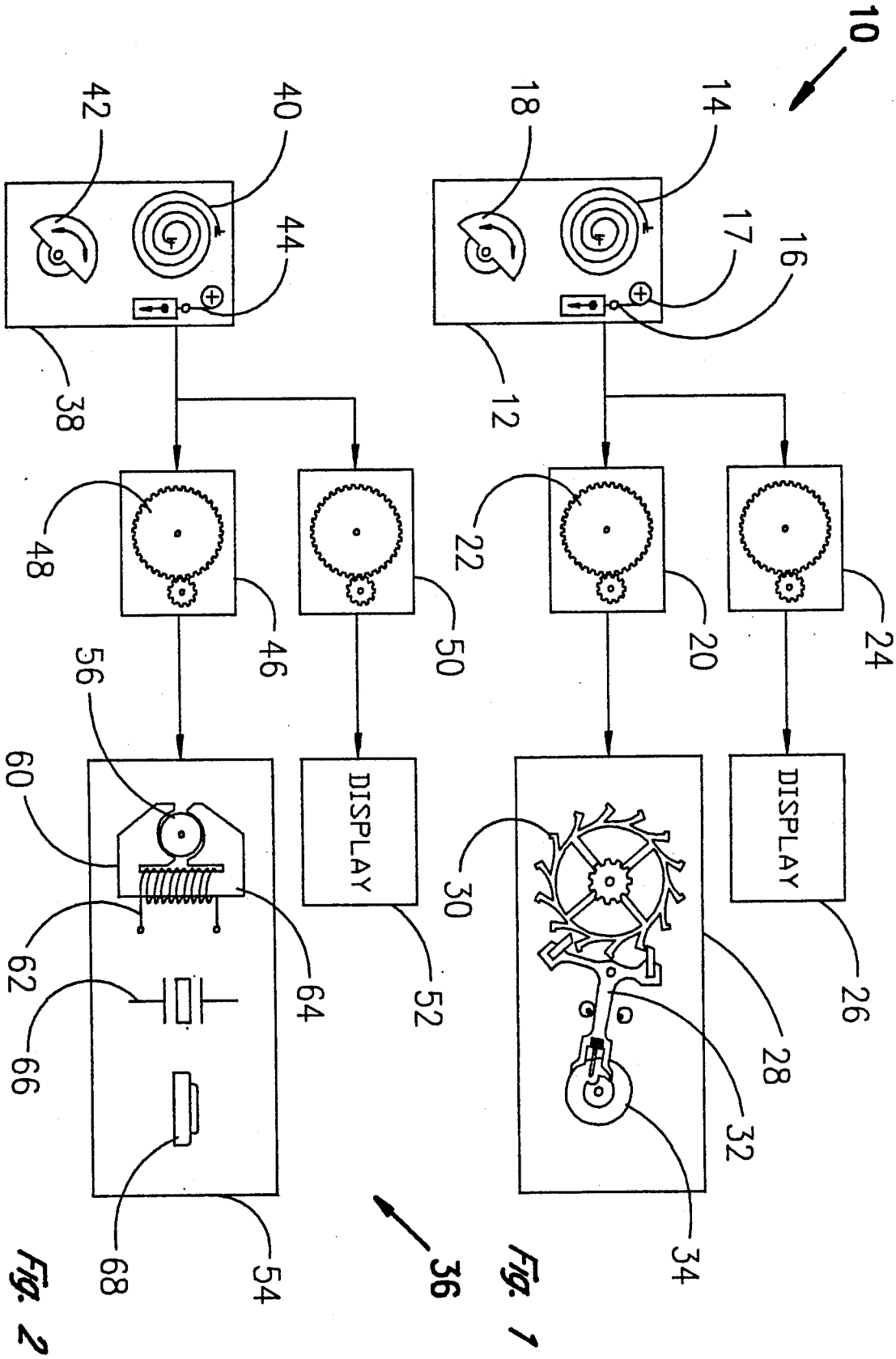
FIG. 1 is a block diagram illustrating existing mechanically driven watch and clock designs.
FIG. 2 is a block diagram illustrating the present invention incorporating an electromagnetic escapement for mechanically driven watches or clocks.

Referring to the drawings in detail, FIG. 1 is a simplified block diagram 10 illustrating existing mechanically driven watch and clock designs. The present invention might also be used with other mechanically driven devices, such as seismograph registers.

An energy generator 12 may consist of a mainspring 14 which is periodically wound. The unwinding of the spring supplies the 15 motive force for the timekeeping device. A driving weight suspended from a chain 16 which is wrapped around a barrel 17 may also be used. The force of gravity on the weight causes the barrel to rotate.

A modification of the periodically wound mainspring 14 is the self-winding mechanism 18 which is used with watches to continuously wind the mainspring. The movement of the wearer causes an oscillating weight to move. The force of the oscillating weight is used to wind the mainspring.

In each instance, the energy generator mechanism 12 is the motive force for the timekeeping device and is connected to an energy transmission system 20. The energy transmission system may include a gear train 22. A separate gear arrangement 24 may be connected to the energy generator 12 to control a display 26 which may be of the analog or digital variety.

The energy transmission system 20 is, in turn, connected to an escapement mechanism to regulate the driving force of the generator. The escapement mechanism 28 may be of several different types. As seen in FIG. 1, the escapement mechanism includes an escape wheel 30 which is engaged with the gear arrangement 22. A pallet fork 32 is engaged with a balance 34. The pallet fork and balance have a number of known designs and modifications thereof. The mechanism holds and releases the driving mechanism according to vibrations of the balance.

The foregoing describes existing escapement mechanisms for mechanically driven timekeeping devices.

A block diagram 36 of the present invention is shown in FIG. 2. A mechanical energy generator 38 may consist of a mainspring 40 which may be periodically wound or may consist of a self winding mechanism 42 in combination with a mainspring. A driving weight suspended from a chain 44 may also be used. As will be appreciated, the present invention may be utilized with any mechanically driven timekeeping device.

The mechanical energy generator 38 is drivingly connected to an energy transmission system 46 including a gear train 48 having interlocking gears.

A separate gear arrangement 50 may be connected to a display 52.

Figures 3, 4:
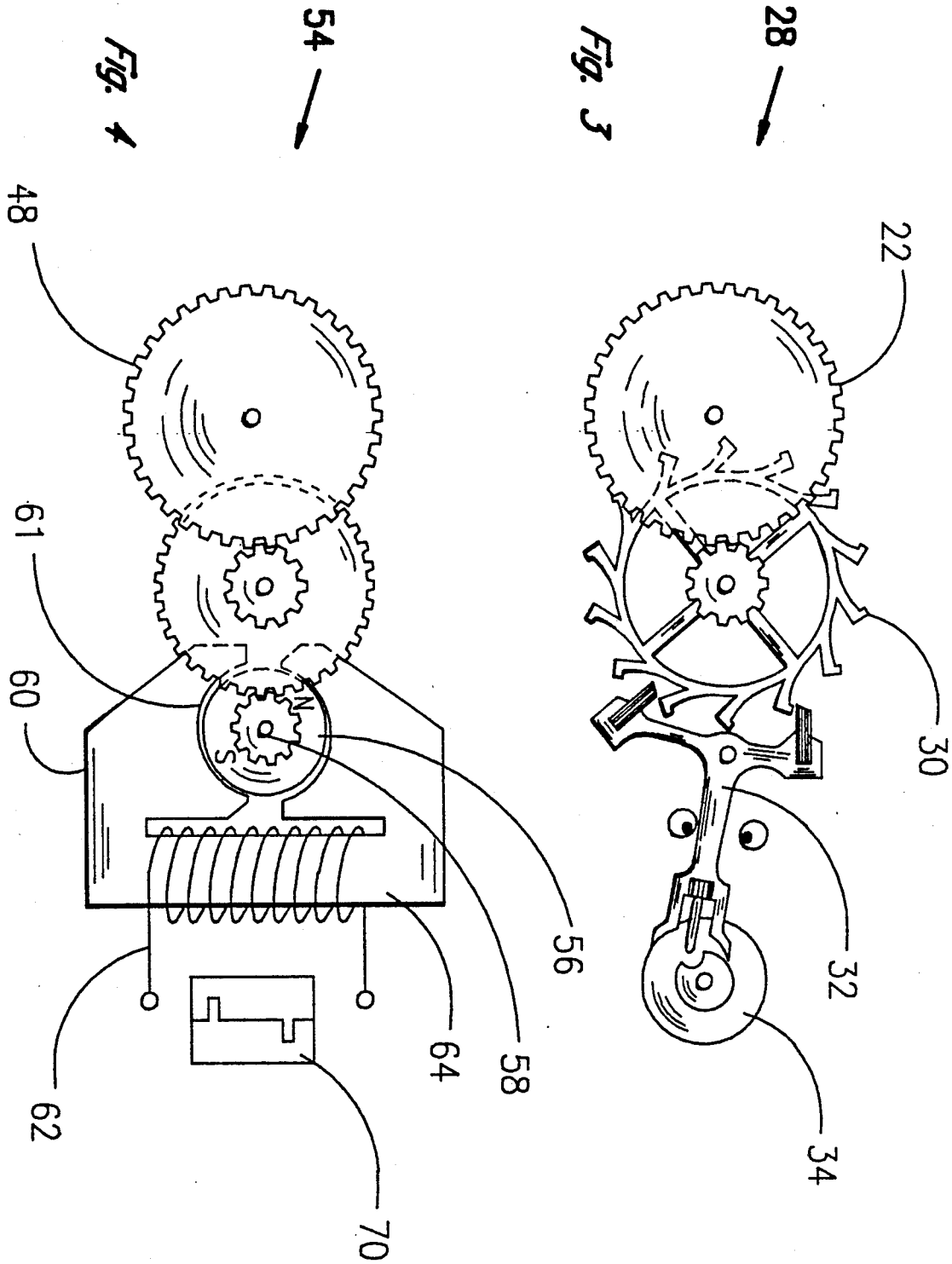
FIG. 3 is an escapement mechanism which could be utilized for existing mechanically driven watches and clocks as seen in FIG. 1.
FIG. 4 is an escapement mechanism for mechanically driven clocks, watches, and other timekeeping devices constructed in accordance with the present invention.

The escapement mechanism is illustrated diagrammatically at 54. FIG. 3 illustrates a typical escapement mechanism 28 presently in use and FIG. 4 shows the escapement mechanism 54 of the present invention.

The last gear of the gear train 48 is drivingly engaged with a rotor 56 which is allowed to rotate about shaft 58. In the present embodiment, the rotor is cylindrical, although other configurations are possible. Accordingly, the drive force of the energy generator is translated to rotational force on the rotor.

The rotor 56 is surrounded by a stator 60 which is constructed of a magnetically permeable substance. The rotor 56 includes a permanent magnet which exerts an attractive force on the stator. It will be appreciated that the permanent magnet will be working against the force of the energy generator. The permanent magnet is strong enough to overcome the force of the mechanical energy generator.

The stator has a pair of arcuate sections 61 which surround the rotor. The stator has a coil wrapped around a bar portion 64. As is well known, passing a current through the coil 62 will polarize the arcuate sections 61.

If the polarity of the current is periodically reversed, the polarity of the arcuate sections will be reversed and the rotor will make 180° rotation on each polarity change.

A quartz resonator 66 kept in a constant state of electrical vibration by a battery 68, will be combined with frequency divider, signal forming and amplifying circuits to deliver square shaped, reversing polarity impulse current to the coil 62, as shown diagrammatically at 70.

By periodically inducing a magnetic field in the arcuate sections 61 of the stator 60, a rotational force will be provided to the rotor.

The system is designed so that the permanent magnet is just slightly stronger than the force of the mechanical energy generator on the rotor. To illustrate by way of example, the mechanical energy generator may supply a clockwise rotational force to the rotor. An impulse of 8/1000th second to the stator will supply a clockwise magnetic force on the rotor. Together, they will overcome the permanent magnet. When the impulse delivered is terminated, the rotor will again lock in place by force of the permanent magnet. After a period of approximately 1 second, an additional impulse will be delivered. Thus, the number of impulses per period of time will determine the speed of the mechanism.

A number of advantages will accrue by use of the present escapement mechanism. Watches and clocks will require less maintenance since a single battery powering the escapement mechanism will last for years. The traditional balance of a watch will be replaced by the present invention, which is the most expensive part of the watch.

Whereas, the present invention has been described in relation to the drawings attached hereto, it should be understood that other and further modifications, apart from those shown or suggested herein, may be made within the spirit and scope of this invention.

What is claimed is:

1. A clock, watch or other timing device which comprises:

mechanical energy generator means supplying a driving force; rotatable rotor means engaged with said driving force resulting in rotational force in a radial direction on said rotor;

magnetically permeable stator surrounding said rotor means;

a permanent magnet within said rotor means, said permanent magnet supplying an attractive force on said stator at least as strong as said rotational force to retain or lock said rotor in said position; and electromagnetic means to periodically induce a magnetic field in said stator to provide a rotational force in said rotor means in the direction of said mechanical generator driving force sufficient to overcome said permanent magnetic force and allow said rotor means to rotate, whereby rotation of said rotor means will be regulated.

2. A clock, watch or other timing device as set forth in claim 1 wherein said stator includes a pair of arcuate sections, said rotor means is in the form of a cylinder having a transverse shaft and said rotor means is mounted between said arcuate sections.

3. A clock, watch or other timing device as set forth in claim 1 wherein said electromagnetic means includes quartz resonator means, frequency divider means and signal forming and amplifying means.

4. A clock, watch or other timing device as set forth in claim 1 including display means in operable engagement with said energy generator means to provide a visual display.

* * * * *